US005323814A

United States Patent [19]

Shiraki et al.

[11] Patent Number: 5,323,814

[45] Date of Patent: Jun. 28, 1994

[54] REED PIECES WITH RECESSED WEFT GUIDE OPENINGS HAVING INCLINED SURFACES

[75] Inventors: Masao Shiraki; Shinichiro Matsuyama; Kunihiro Ishikawa, all of Kariya, Japan

[73] Assignee: Kabushiki Kaisha Toyoda Jidoshokki Seisakusho, Kariya, Japan

[21] Appl. No.: 949,512

[22] PCT Filed: Apr. 1, 1992

[86] PCT No.: PCT/JP92/00401

§ 371 Date: Nov. 24, 1992

§ 102(e) Date: Nov. 24, 1992

[87] PCT Pub. No.: WO92/17630

PCT Pub. Date: Oct. 15, 1992

[30] Foreign Application Priority Data

Apr. 1, 1991 [JP] Japan ..... 3-068594

[51] Int. Cl.[5] ..... D03D 47/30

[52] U.S. Cl. ..... 139/192; 139/435.5; 51/241 S

[58] Field of Search ..... 139/192, 1 C, 435.5; 51/241 S, 270, 324, 281 R; 29/418, 446

[56] References Cited

U.S. PATENT DOCUMENTS

| | | | |
|---|---|---|---|
| 3,847,187 | 11/1974 | Buran et al. | 139/435.5 |
| 4,190,067 | 2/1980 | Kuda et al. | 139/435.5 |
| 4,304,269 | 12/1981 | Suzuki et al. | 139/435.5 |
| 4,315,590 | 2/1982 | Suzuki et al. | 139/435.5 |
| 4,433,705 | 2/1984 | Cech et al. | 139/435.5 |
| 4,458,732 | 7/1984 | Yoshida et al. | 139/435.5 |
| 4,516,610 | 5/1985 | Onish et al. | 139/435.5 |
| 4,538,649 | 9/1985 | Kobayashi et al. | 139/435.5 |
| 4,606,152 | 8/1986 | Michihara et al. . | |
| 5,001,872 | 3/1991 | Mitchell et al. | 51/281 R |

FOREIGN PATENT DOCUMENTS

| | | |
|---|---|---|
| 59-26688 | 6/1984 | Japan . |
| 60-194152 | 10/1985 | Japan . |
| 61-289151 | 12/1986 | Japan . |
| 63-772 | 1/1988 | Japan . |
| 63-94989 | 6/1988 | Japan . |
| 1314753 | 12/1989 | Japan . |

*Primary Examiner*—Andrew M. Falk

*Attorney, Agent, or Firm*—Brooks Haidt Haffner & Delahunty

[57] ABSTRACT

A weft insertion device for a jet loom prevents weft the distal or leading end of the weft from being ejected from the weft passage before reaching the exit end of the passage in the reed, while improving the flying speed of a weft. The weft insertion device has a reed provided with a plurality of reed pieces (3A, 3B, 9A, 9B) having guide openings (4, 5, 14, 15) recessed in the front faces thereof. The wall portion of each guide opening of the reed has at least one wall surface (4*b*, 5*b*, 14*e*, 14*g*, 15*e*) provided to guide air flowing through a weft passage (S). The inclination angle of the wall surfaces (4*b*, 14*e*, 14*g*), provided at the wall portions of the guide openings of those reed pieces (3A, 9A) which are arranged in a first section (L1), located closer to a main nozzle, suppresses air leakage toward the opening side of the weft passage. The inclination angle of the wall surfaces (5*b*, 15*e*), provided at the wall portions of the guide openings of those (3B, 9B) of the line of the reed pieces which are arranged in a second section (L2) located opposite to the main nozzle, is set to collect air in the center of the weft passage.

8 Claims, 10 Drawing Sheets

REED PIECES WITH RECESSED WEFT GUIDE OPENINGS HAVING INCLINED SURFACES

TECHNICAL FIELD

The present invention relates to a weft insertion device in a jet loom, which inserts a weft into warp openings by the action of jet air. More particularly, this invention relates to a weft insertion device with an improved reed including reed pieces, each having a guide opening for flying weft, which is formed in the front face of the reed piece. Further, this invention relates to a reed for the weft insertion device and a method for-producing the reed.

BACKGROUND ART

In general, a jet loom has a main nozzle for spouting, i.e., directing, projecting or ejecting, a weft into warp openings, and a reed which has a plurality of reed pieces arranged between warps, in order to beat a weft, inserted in the warp openings, in a cloth fell. As shown in FIG. 13, a weft insertion device for a jet loom has an open type guide openings 32, and is formed in the front faces of the reed pieces 31. The walls of the guide openings 32 form a passage S for weft insertion.

Japanese Examined Patent Publication No. 59-26688 and Japanese Unexamined Patent Publication No. 1-314753 disclose weft insertion devices, in which the open type guide opening 32 has its top wall surface 32*a*, side wall surface 32*b* and bottom wall surface 32*c* inclined toward the weft passage S in the weft inserting direction, in order to improve the speed of a weft flying through the weft passage.

In the weft insertion device disclosed in the Japanese Examined Patent Publication No. 59-26688, the inclination angles of the individual wall surfaces 32*a*, 32*b* and 32*c* of each guide opening are increased in order to increase the flow speed of jet air in the weft passage, thereby increasing the weft flying speed. The increase in the inclination angle of the side wall surface 32*b* increases the amount of air leak from the guide openings, which cause a flying trouble, such as the distal end of the weft flying out of the weft passage. However, this design increases the weft flying speed.

In the weft insertion device disclosed in the Japanese Unexamined Patent Publication No. 1-314753, the inclination angle of the top wall surface 32*a* is greater than that of the side wall surface 32*b*. Further, a jet air from a plurality of sub-nozzles arranged along the weft passage S is directed toward the top wall surfaces 32*a* and the side wall surfaces 32*b* of the individual guide openings. This setting of the inclination angles of the top wall surface 32*a* and side wall surface 32*b* will suppress air leakage from the guide openings.

In the weft insertion devices disclosed in both publications, however, the inclination angles of the wall surfaces 32*a*, 32*b* and 32*c* of each guide opening are set evenly from the weft insertion inlet end to the outlet end thereof. This angle setting is not an effective means to improve the weft flying speed, while preventing the weft from flying away from the weft passage.

The flow rate of air upstream the weft passage becomes the sum of the flow rate of jet air from the main nozzle and that of jet air from the individual sub-nozzles. Therefore, the flow rate of the air moving upstream, becomes about twice that of the air moving downstream, which is less affected by the jet stream from the main nozzle. Due to this flow ratio, the amount of the air leak, toward the opening side of the guide openings of those reed pieces located upstream of the weft passage, is greater than that of the air leak located downstream.

If the inclination angle of all the side wall surfaces is smaller in view of the air leak toward the opening side of the upstream guide openings, it is possible to prevent the weft from flying away from the weft passage, but it is difficult to improve the flying speed. If the inclination angle of all the side wall surfaces is greater in accordance with the maximum allowable air leak toward the opening side of the downstream guide openings, on the other hand, it is possible to improve the flying speed, but it is not possible to effectively prevent the weft from flying away from the weft passage. Even if the inclination angles of the top wall surface 32*a* and the side wall surface 32*b* are set different from each other as described above, it will be difficult to prevent the weft from flying away from the weft passage, as well as to improve the flying speed.

It is therefore an object of the present invention to provide an improved weft insertion device in a jet loom using an improved reed, including open type guide openings. The improved device can effectively prevent the flying trouble while improving the flying speed of a weft. It is also another object of this invention to provide a reed for the weft insertion device and a method of producing the reed.

DISCLOSURE OF THE INVENTION

To achieve the foregoing and other objects and in accordance with the purpose of the present invention, there is provided an improved weft insertion device for a jet loom which has a reed, a main nozzle and sub-nozzles. The reed has a plurality of reed pieces each having a guide opening formed in the front face, a line of the guide openings forming a weft passage for the flying wefts. The main nozzle ejects the weft toward the weft passage. The sub-nozzles spout air toward the weft passage to help the weft fly. The wall portion of each guide opening of the reed has at least one wall surface provided to guide air flowing through the weft passage.

Further, the inclination angle of the wall surfaces, provided at the wall portions of the guide openings of the reed pieces, which are arranged in a first section located closer to the main nozzle, is designed to suppress air leak toward the opening side of the weft passage, in order to prevent a flying weft from flying away from the guide openings. The inclination angle of the wall surfaces, provided at the wall portions of the guide openings of the reed pieces, which are arranged in a second section located opposite to the main nozzle, is set to collect air in the center of the weft passage, in order to prevent the flying speed of the weft from dropping.

With this structure, the setting of different inclination angles of the wall surfaces in the first section corresponding to the upstream portion of the weft passage, and those in the second section corresponding to the downstream portion, is done in accordance with the degrees of influence of jet air from the main nozzle in those sections.

In the upstream portion which is affected greatly by the jet air from the main nozzle, air leakage toward the opening side of the guide openings is suppressed, in order to prevent flying trouble, rather than to improve the flying speed. In the downstream portion, which is less affected by the jet air from the main nozzle, the flying trouble which originated from the air leakage toward the opening side of the guide openings hardly occurs, so that greater emphasis is put on the improvement of the flying speed rather than the suppression of the air leak toward the opening side of the guide openings.

As a first aspect of this weft insertion device, it is preferable that the wall surfaces of the guide openings of the individual reed pieces be inclined downward, toward the weft passage, in the weft inserting direction, and that the inclination angle of the wall surfaces of the guide openings of the reed pieces located in the first section, be smaller than that of the wall surfaces of the guide openings of the reed pieces located in the second section.

According to this arrangement, the air reflected at the wall surfaces of the guide openings decreases in the first section, while air leakage from between the reed pieces to the rear side of the reed increases relatively. It is thus possible to suppress air leakage toward the opening side of the guide openings, thus preventing the flying trouble. In the second section, the air returning at the wall surfaces of the guide openings increases, while air leakage from between the reed pieces to the rear side of the reed decreases relatively. Air is thus collected in the center of the weft passage, thus improving the weft flying speed.

As a second aspect of this weft insertion device, it is preferable that the wall portions of the guide openings of the individual reed pieces have wall surfaces inclined downward, toward the weft passage, in the weft inserting direction, and that the wall portions of the guide openings of the reed pieces located in the first section have second wall surfaces inclined opposite to the weft passage in the weft inserting direction.

According to this arrangement, the second wall surfaces increase air leakage from between the reed pieces to the rear side of the reed, and generate a suction stream that attracts a flying weft to the wall portions of the guide openings. This suction stream weakens the action of the air stream reflected at the inclined surfaces that drop toward the weft passage in the weft inserting direction. Similar to the first aspect, therefore, air leakage toward the opening side of the guide openings is suppressed in the first section, and weft flying speed is improved in the second section.

BEST MODE FOR CARRYING OUT THE INVENTION

A first embodiment of the present invention will be described below referring to FIGS. 1 through 5. A second embodiment will be described referring to FIG. 6, and a third embodiment and a method of producing a reed therefor will be described referring to FIGS. 7 through 12.

First Embodiment

Figure 1:
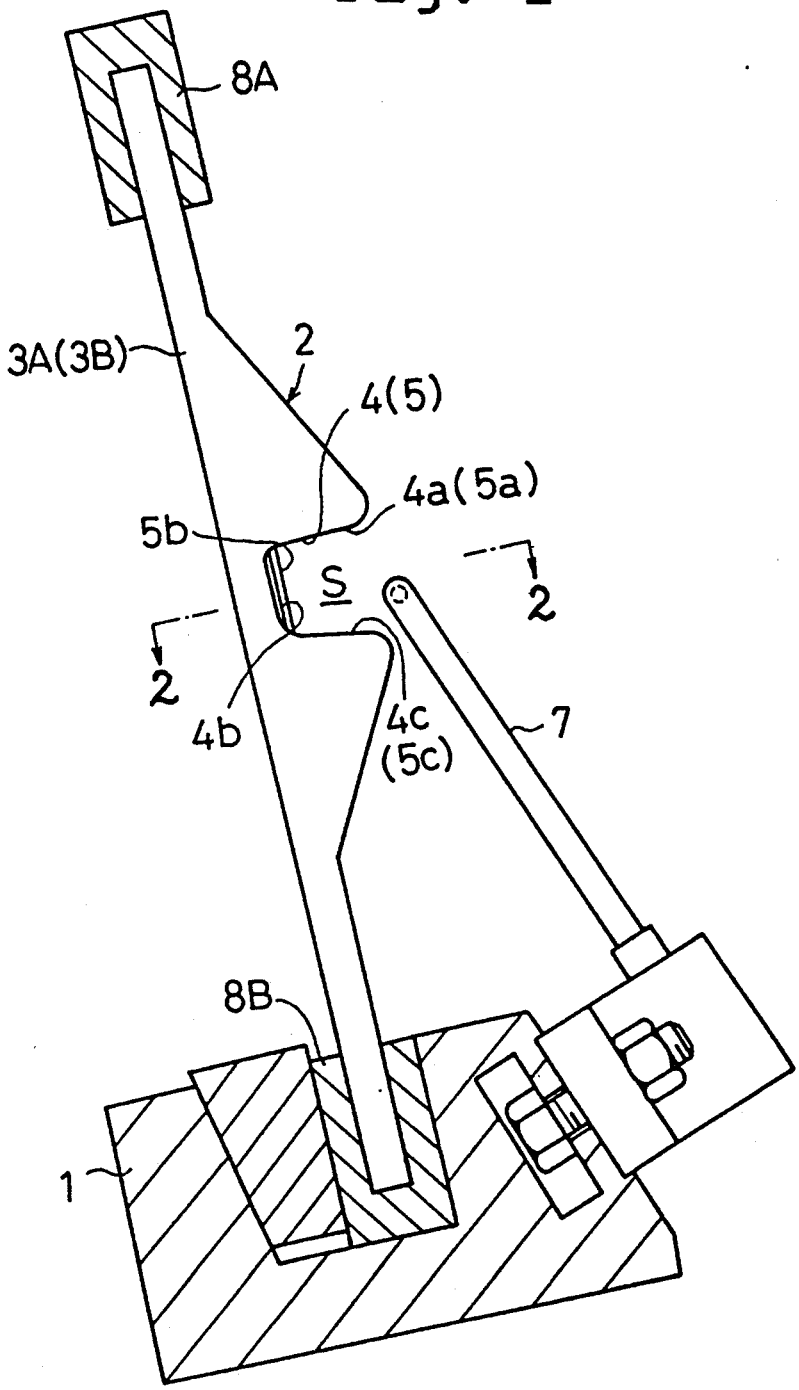
FIG. 1 is a side cross sectional view of a weft insertion device according to a first embodiment of the present invention.
Figure 2:
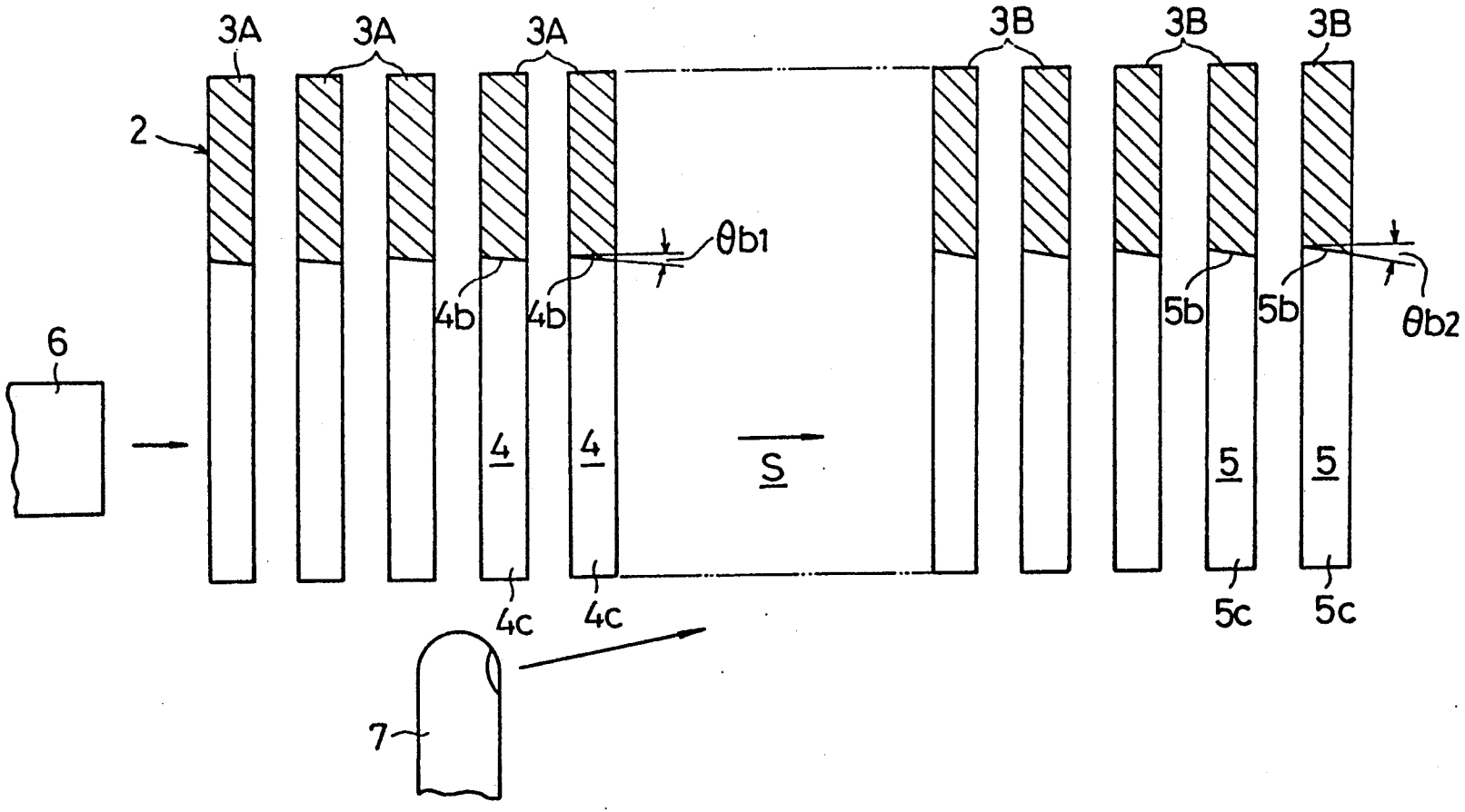
FIG. 2 is an enlarged cross sectional view of a reed taken along line 2—2 in FIG. 1.
Figure 3:
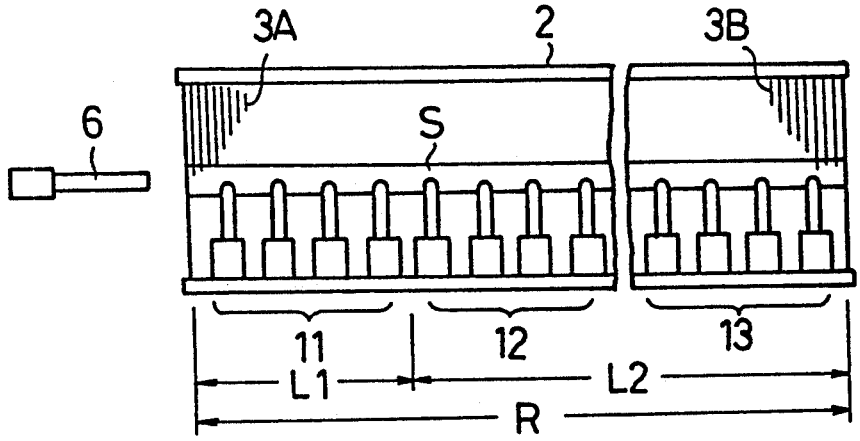
FIG. 3 is a front view of the weft insertion device of FIG. 1.

As shown in FIGS. 1 to 3, an improved reed 2 is secured to a slay 1 that swings in accordance with the operation of a jet loom. The reed 2 comprises a pair of upper and lower stays 8A and 8B and a plurality of reed pieces (3A, 3B). The stays 8A and 8B are connected to the multiple reed pieces (3A, 3B), and are equidistally disposed along the slay 1 at the upper and lower ends of the reed pieces.

The reed pieces (3A, 3B) have guide openings (4, 5) formed in their front faces, for forming a passage (S) for the weft insertion. The guide openings (4, 5) have generally horizontal top wall surfaces (**4*a*, 5*a*), respectively. They also have generally vertical side wall surfaces (4*b*, 5*b*), and bottom wall surfaces (4*c*, 5*c*) that are slightly inclined with respect to the top wall surfaces (4*a*, 5*a*). The guide openings (4, 5) are defined by these wall surfaces, and are generally shaped like rectangular recesses thereby. The side wall surfaces (4*b*, 5*b*) of the individual guide openings (4, 5**) are inclined with respect to the axis for the weft insertion.

As shown in FIGS. 1 and 3, a main nozzle 6 for weft insertion is provided at one end of the slay 1. A plurality of sub-nozzles 7 are arranged at equal intervals at the front face of the slay 1. Multiple sub-nozzles 7 (four in this embodiment) form a group. The sub-nozzle groups include a primary sub-nozzle group 11 closest to the main nozzle 6, a secondary sub-nozzle group 12 adjacent to the primary group 11, and a distal sub-nozzle group 13.

The individual sub-nozzles 7 constituting each sub-nozzle group spout air simultaneously, and the primary sub-nozzle group 11 to the distal sub-nozzle group 13 spout air sequentially. The primary sub-nozzle group 11 jets air at the same time as the main nozzle 6. The individual sub-nozzle groups spout approximately the same amount of air as the amount of jet air from the main nozzle 6, to help a weft fly in the weft passage (S).

As shown in FIG. 3, the length of the weft passage (S) formed by the multiple reed pieces (3A, 3B) is equivalent to the gap (R) between both reed pieces located at the right and left ends of the reed 2. The weft passage (S) is separated into a front section L1 and a rear section L2 by the boundary between the primary sub-nozzle group 11 and the secondary sub-nozzle group 12.

As shown in FIG. 2, the inclination angle of the side wall surfaces 4*b* of the reed pieces 3A arranged in the front section L1 to the weft insertion axis, $\Theta_{b1}$, is set smaller than the inclination angle of the side wall surfaces 5*a* of the reed pieces 3B arranged in the rear section L2 to the weft insertion axis, $\Theta_{b2}$ ($\Theta_{b1}<\Theta_{b2}$).

While part of the air flowing in the weft passage (S) leaks to the back of the reed 2 from between the side wall surfaces (4*b*, 5*b*), it is reflected toward the opening side (front side of the reed 2) of the guide openings (4, 5) by the side wall surfaces (4*b*, 5*b*). The air stream directed toward the opening side of the guide openings (4, 5) acts to increase the weft flying speed, it also acts to cause the weft to fly out of the weft passage (S). In contrast, the air stream leaking toward the back of the reed 2 acts to draw the weft in the weft passage (S).

The setting of the different inclination angles of the individual side wall surfaces 4*b* and 5*b* in the front section L1 and the rear section L2 is done in accordance with the degrees of influence of jet air from the main nozzle 6. More specifically, in the front section L1 which is affected greatly by the jet stream from the main nozzle 6, the inclination angle $\Theta_{b1}$ of the side wall surface 4*b* is set smaller, in order to decrease the reflection of the air flow at the side wall surface 4*b*, while increasing the air leakage toward the back of the reed 2. As a result, the air leakage to the opening side of the guide openings 4 is suppressed, thus preventing the flying trouble.

In the rear section L2, the inclination angle $\Theta_{b2}$ of the side wall surface 5*b* is set larger to increase the reflection of the air flow at the side wall surface 5*b*, while reducing the air leakage toward the back of the reed 2. As a result, the weft flying speed increases. In the rear section L2, which is less affected by the jet air from the main nozzle 6, the air leakage to the opening side of the guide openings 5 is less occurrable than that in the front section L1. This minimal amount of air leakage toward the opening side would compensate for an increase in the amount of leakage due to the air reflection, based on the larger inclination angle $\Theta_{b2}$ of the side wall surfaces 5*b*. It is therefore possible to increase the flying speed in the rear section L2 without causing the flying trouble.

The difficulty in improving the flying speed in the front section L1 is compensated by the improved flying speed in the rear section L2. According to this embodiment, therefore, the flying trouble can be avoided while maintaining the high weft flying speed through the entire weft passage.

Figure 14:
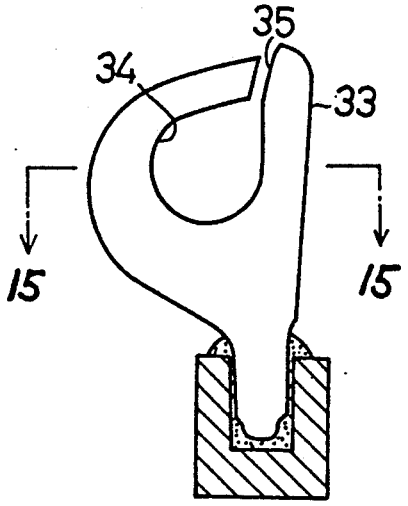
Fig. 14 (Prior Art)
FIG. 14 is a diagram showing the essential portion of a conventional close type guide piece.
Figure 15:
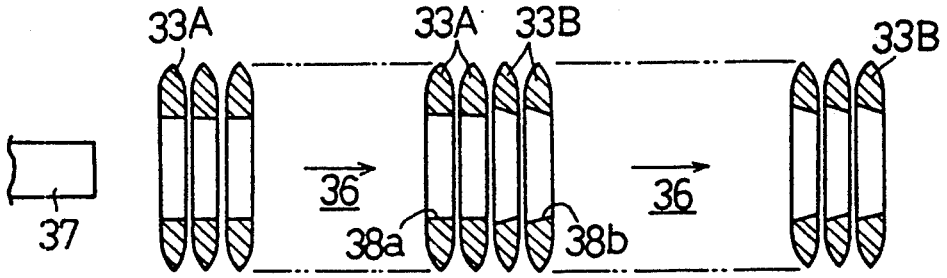
Fig. 15 (Prior Art)
FIG. 15 is a cross sectional view showing a series of guide pieces taken along line 15—15 in FIG. 14.

Japanese Examined Utility Model Publication No. 63-772 discloses a weft insertion device, as shown in FIGS. 14 and 15. In this device, a plurality of guide pieces 33, each of which has an air guide opening 34 and a clearance 35 for weft release, are arranged in the weft insertion direction. A series of air guide openings 34 form a guide passage 36. Inner wall surfaces 38*a* of the air guide openings of the guide piece 33A are arranged in a section from a main nozzle 37 to a middle of the guide passage 36, and are formed in parallel to the axis of the guide passage 36. Further, the inner wall surfaces 38*b* of the air guide openings of the remaining guide piece 33B are tapered in a decreasing narrower in the weft insertion direction.

Since the guide pieces 33 of this device are of a so-called close type, the weft will not fly out of the guide passage by the jet stream from the main nozzle 37. Furthermore, since an increase in the inclination angle of the inner wall surfaces 38*b* in the close type reduces the flying speed, the object, action and advantages of the present invention cannot be expected in such close type of guide pieces.

The present invention is not limited to the first embodiment. The main nozzle 6 may be arranged slightly tilting toward the weft insertion axis. The side wall surfaces 4*b* of the reed pieces 3A may be set parallel to the weft insertion axis (i.e., at an inclination angle $\Theta_{b1}=0°$).

Figure 4:
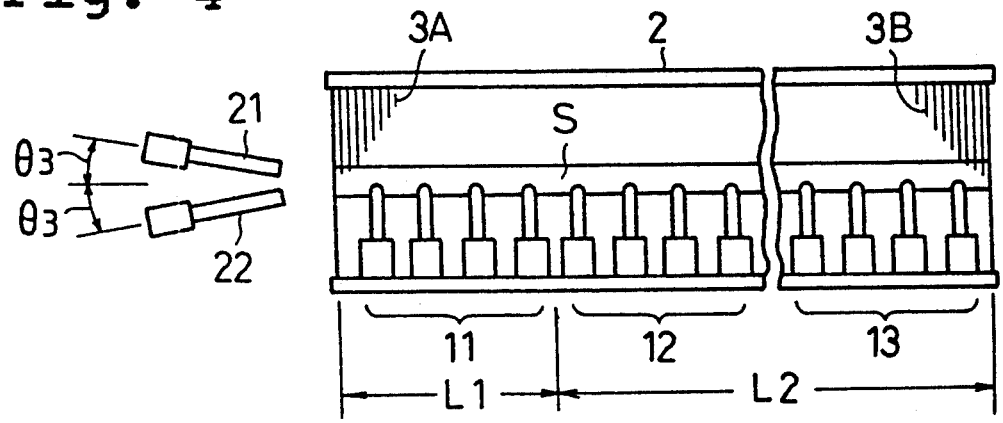
FIG. 4 is a front view of another example of the weft insertion device of the present invention.

The present invention may be applied to a weft insertion device which has two main nozzles 21 and 22 tilting downwardly and upwardly at the same angle $\Theta_3$ with respect to the weft insertion axis, as shown in FIG. 4. Such a weft insertion device is used when multiple wefts of different colors are used. The front section L1 is set in association with a region which is greatly affected by the jet stream from both main nozzles 21 and 22.

Figure 5:
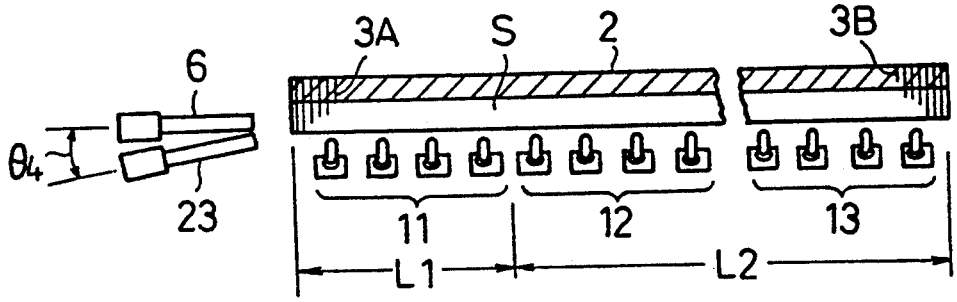
FIG. 5 is a plane cross section of a further example of the weft insertion device of the present invention.

Further, the present invention may be applied to a multi-colored weft insertion device which has a second main nozzle 23 inclined, at an angle of $\Theta_4$, frontward of the main nozzle 6 arranged on substantially the same axis as the weft insertion axis, as shown in FIG. 5.

With this structure, because the inclination angle $\Theta_{b1}$ of the side wall surfaces 4*b* of the reed 2 is relatively small, although the second main nozzle 23 is inclined, the angle at which jet air from the second main nozzle 23 is reflected at the side wall surfaces 4*b* of the reed pieces 3A becomes smaller relative to the weft insertion axis. A flying trouble of the weft ejected from the second main nozzle 23 can therefore be prevented. In this example too, the front section L1 is set in association with a region which is greatly affected by the jet stream from both main nozzles 6 and 23.

Second Embodiment

In the first embodiment, only the side wall surfaces (4*b*, 5*b*) of the guide openings (4, 5) are inclined with respect to the weft insertion axis. In this second embodiment, the top wall surfaces (4*a*, 5*a*) and the bottom wall surfaces (4*c*, 5*c*) of the individual guide openings (4, 5) are also inclined with respect to the weft insertion axis.

Figure 6:
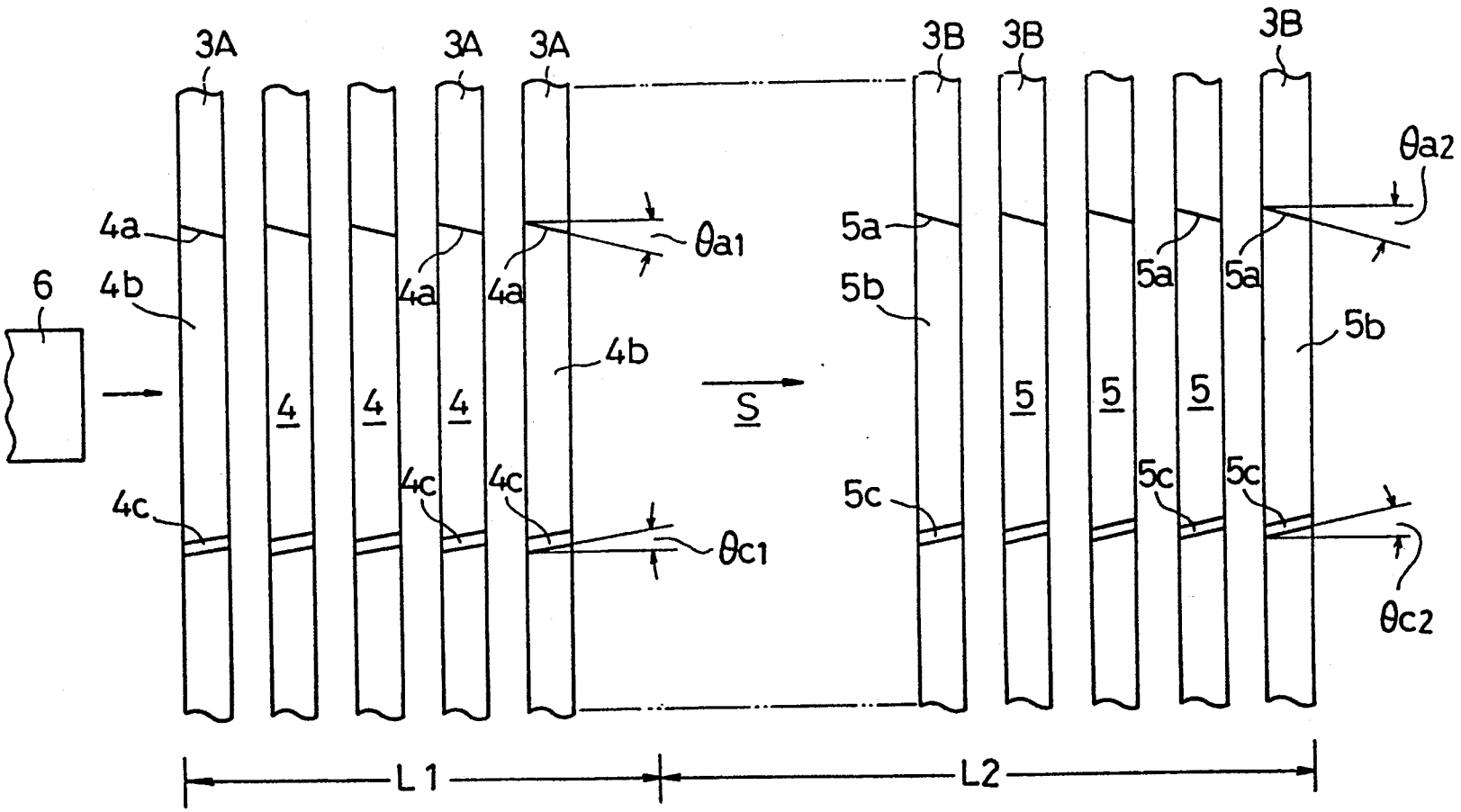
FIG. 6 is a front view of a reed for the weft insertion device according to a second embodiment of the present invention.

As shown in FIG. 6, angles $\Theta_{a1}$ and $\Theta_{c1}$ respectively represent inclination angles of the top wall surfaces 4*a* and bottom wall surfaces 4*c* of the reed pieces 3A, that are arranged in the front section L1, with respect to the weft insertion axis. Likewise, angles $\Theta_{a2}$ and $\Theta_{c2}$ respectively represent inclination angles of the top wall surfaces 5*a* and bottom wall surfaces 5*c* of the reed pieces 3B that are arranged in the rear section L2, with respect to the weft insertion axis.

In the guide openings 4 in the front section L1, the inclination angle $\Theta_{a1}$ of the top wall surfaces 4*a*, is set greater than the inclination angle $\Theta_{b1}$ of the side wall surfaces 4*b* and the inclination angle $\Theta_{c1}$ of the bottom wall surfaces 4*c*. The inclination angle $\Theta_{b1}$ of the side wall surfaces 4*b* is set equal to, or larger than the inclination angle $\Theta_{c1}$ of the bottom wall surfaces 4*c*. The inclination angles $\Theta_{a2}$, $\Theta_{b2}$ and $\Theta_{c2}$ of the individual wall surfaces of the guide openings 5 in the rear section L2 are set similarly. In other words, the inclination angles of the individual wall surfaces of each guide opening satisfy relationships given by the following equations (1) and (2):

$$\Theta_{c1} \leqq \Theta_{b1} < \Theta_{a1} \quad (1)$$

$$\Theta_{c2} \leqq \Theta_{b2} < \Theta_{a2} \quad (2)$$

The reason, why the inclination angles $\Theta_{c1}$, $\Theta_{c2}$) of the bottom wall surfaces (4c, 5c) are set smaller than the inclination angles ($\Theta_{a1}$, $\Theta_{a2}$) of the top wall surfaces (4a, 5a), is that if the inclination angles ($\Theta_{c1}$, $\Theta_{c2}$) are acute, the reflection stream by the bottom wall surfaces (4c, 5c) would disturb the reflection stream by the top wall surfaces (4a, 5a), thus increasing the leakage of jet stream toward the opening side of the guide openings. Under such condition, the flying speed will drop and the weft flying trouble is likely to occur.

As in the first embodiment, the inclination angles of the wall surfaces in the front section L1 are set such that they may be equal to, or smaller than those of the wall surfaces in the rear section L2. In this embodiment, the corresponding inclination angles of the individual wall surfaces in the front section L1 and the rear section L2 satisfy the following equations (3), (4) and (5).

$$\Theta_{a1} = \Theta_{a2} \quad (3)$$

$$\Theta_{b1} < \Theta_{b2} \quad (4)$$

$$\Theta_{c1} < \Theta_{c2} \quad (5)$$

As the inclination angles of the individual wall surfaces are so set as to satisfy equations (1) through (5) above, this embodiment can improve the flying speed and prevent the flying trouble more effectively than the first embodiment.

Third Embodiment

Figure 8:
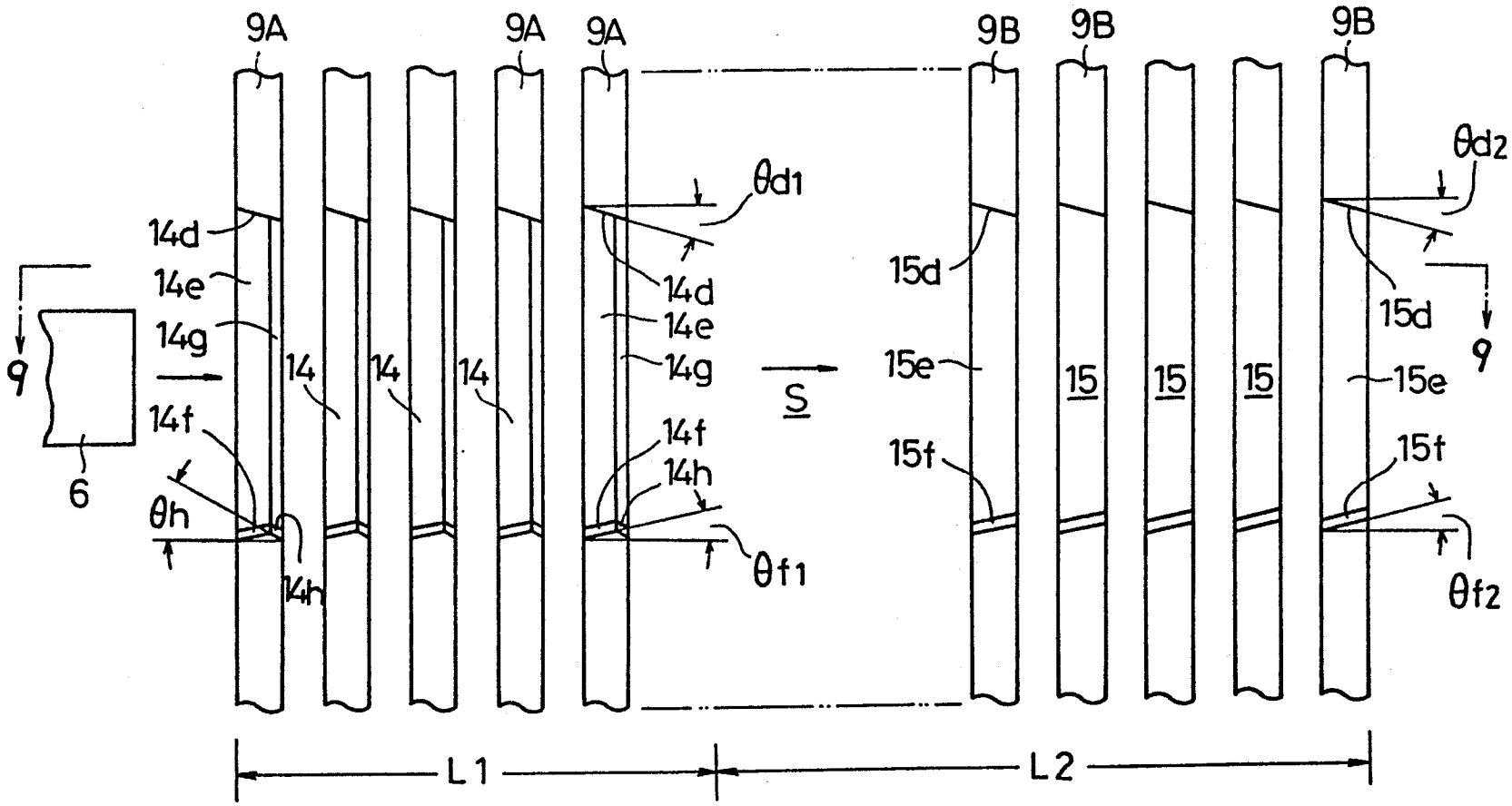
FIG. 8 is a diagrammatic view illustrating the completed reed for the weft insertion device according to the third embodiment of the present invention.
Figure 9:
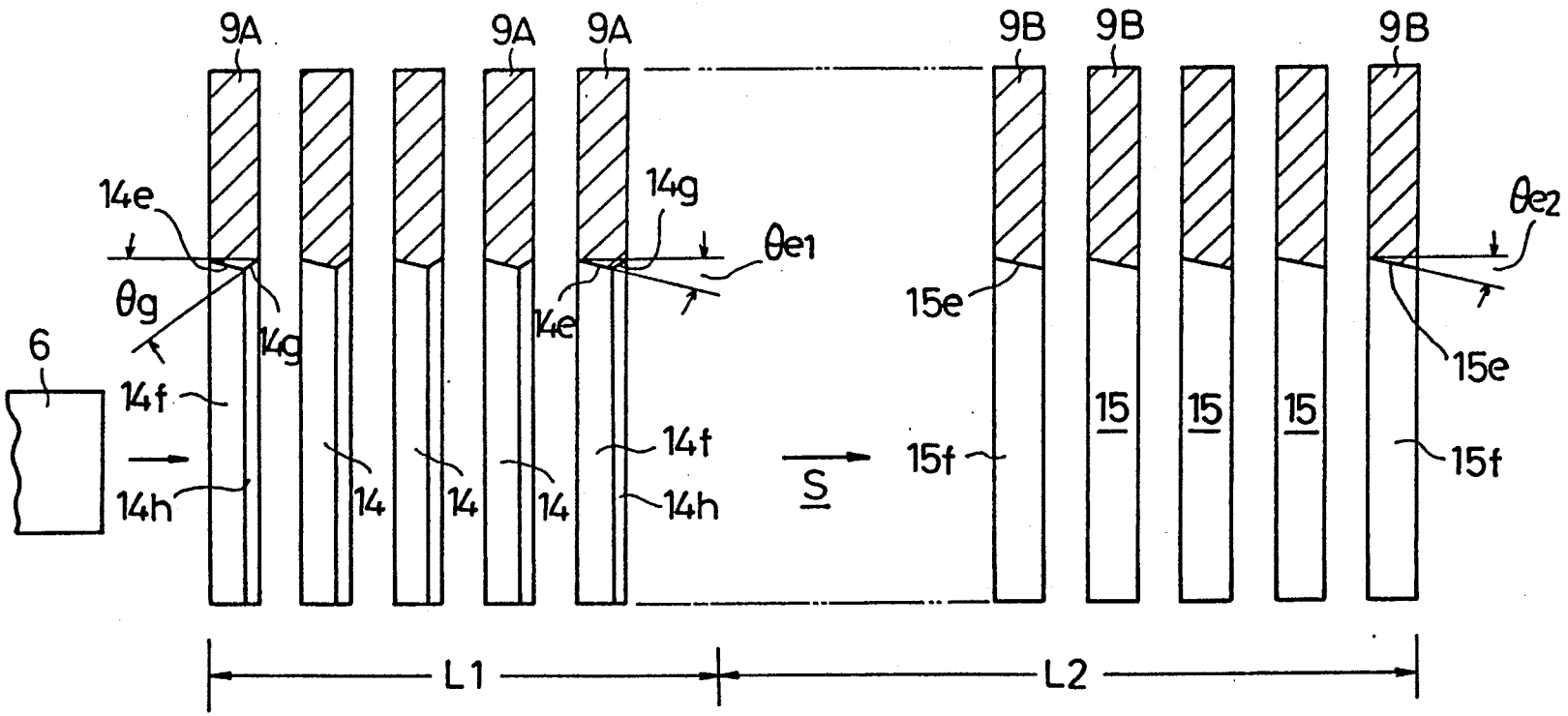
FIG. 9 is a cross sectional view taken along line 9—9 in FIG. 8.

In this third embodiment, as shown in FIG. 8 and 9, guide openings 14 and guide openings 15 are formed in the reed pieces 9A that are arranged in the front section L1, and in the reed pieces 9B that are arrange$_d$ in the rear section L2, respectively. The guide opening 15 in the rear section L2 is formed by a top wall surface 15d (inclination angle $\Theta_{d2}$), a side wall surface 15e (inclination angle $\Theta_{e2}$) and a bottom wall surface 15f (inclination angle $\Theta_{f2}$). The guide opening 14 in the front section L1 is formed by a top wall surface 14d (inclination angle $\Theta_{d1}$), a side wall having a first side wall surface 14e and a second side wall surface 14g, and a bottom wall having a first bottom wall surface 14f and a second bottom wall surface 14h.

The first side wall surface 14e and the first bottom wall surface 14f of the guide opening 14 have inclination angles $\Theta_{e1}$ and $\Theta_{f1}$, respectively, inclining toward the weft passage (S) in the weft insertion direction. The second side wall surface 14g and second bottom wall surface 14h of the guide opening 14 have inclination angles $\Theta_g$ and $\Theta_h$, respectively, inclining toward the opposite side of the weft passage (S) in the weft insertion direction.

The inclination angles of the forward inclined wall surfaces of each guide opening are so set as to satisfy relationship given by the following equation (6):

$$\Theta_{f1} = \Theta_{f2} = \Theta_{e1} = \Theta_{e2} < \Theta_{d1} = \Theta_{d2} \quad (6)$$

The inclination angles $\Theta_g$, and $\Theta_h$ of the second side wall surface 14g and second bottom wall surface 14h are respectively set greater than the inclination angles $\Theta_{e1}$ and $\Theta_{f1}$ of the first side wall surface 14e and the first bottom wall surface 14f ($\Theta_{e1} < \Theta_g$, $\Theta_{f1} < \Theta_h$).

The corresponding side wall surfaces 14e and 15e in the front section L1 and the rear section L2 are set to have the same inclination angle, while the corresponding bottom wall surfaces 14f and 15f are set to have the same inclination angle. Even with this setting, the side wall surface and bottom wall surface in the front section L1 have the second side wall surface 14g and the second bottom wall surface 14h, respectively. Accordingly, the amount of air reflection by the side wall surfaces and bottom wall surfaces in the front section L1 is smaller than that of the air reflection by the side wall surfaces 15e and the bottom wall surfaces 15f in the rear section L2. This is because the amount of air sucked between the reed pieces 9A increases due to the action of the reversely inclined second side wall surfaces 14g and second bottom wall surfaces 14h, thus weakening the air reflection toward the opening side of the weft passage by the first side wall surfaces 14e and the first bottom wall surfaces 14f.

Therefore, this structure can also accomplish the prevention of the flying trouble in the front section L1 and the improvement of the flying speed in the rear section L2, according to the first and second embodiments.

The inclination angles of the individual wall surfaces may be set to satisfy a relationship given by the following equation (7), instead of the equation (6):

$$\Theta_{f1} = \Theta_{f2} < \Theta_{e1} = \Theta_{e2} < \Theta_{d1} = \Theta_{d2} \quad (7)$$

The front section L1, described in the first to third embodiments, corresponds to a region which is greatly affected by the jet stream from the main nozzle. Although this region varies by the jet pressure of the main nozzle, the length of the front section L1 in an ordinary jet loom is set within a range of 50 mm to 500 mm. The reed width of the jet loom (L1+L2) is generally designed to be within a range of 1 to 3.5 m.

Method of Producing Reed

The method of producing the improved reed of the third embodiment will now be described in greater detail.

Figure 10:
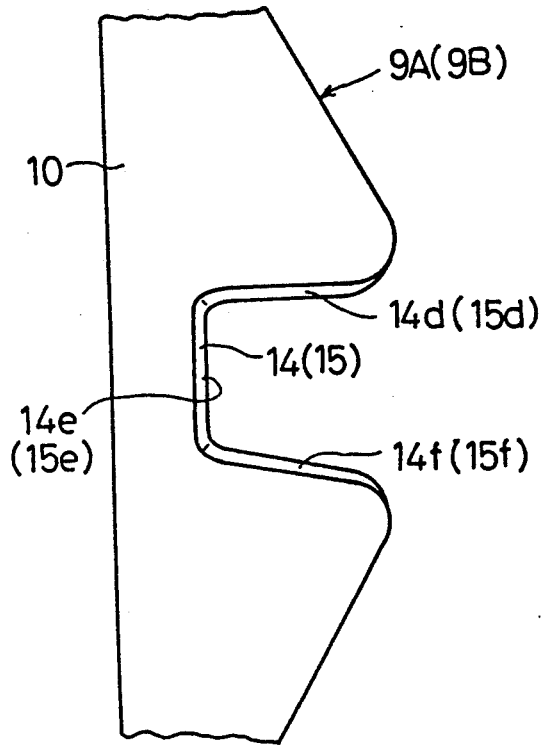
FIG. 10 is a diagrammatic view showing the essential portion of a reed piece immediately after stamping.

The reed pieces (9A, 9B) having the guide openings (14, 15) are produced by stamping a metal plate having a thickness of 2 mm to 4 mm, with a press machine. In this case, the individual wall surfaces, which form the guide openings (14, 15) of the reed pieces (9A, 9B), will not actually be perpendicular to the sides 10 of the reed pieces (9A, 9B), due to the characteristics of the stamping procedure, as shown in FIG. 10. That is, the individual wall surfaces 14d, 14e, 14f, 15d, 15e and 15f originally have inclinations in the direction of the centers of the guide openings, in the stamping direction.

As the influence of the stamping appears equally on the individual wall surfaces, the inclination angles of the wall surfaces, immediately after stamping, are given by the following equation (8):

$$\Theta_{f1}(=\Theta_{f2}) = \Theta_{e1}(=\Theta_{e2}) = \Theta_{d1}(=\Theta_{d2}) \quad (8)$$

Figure 7:
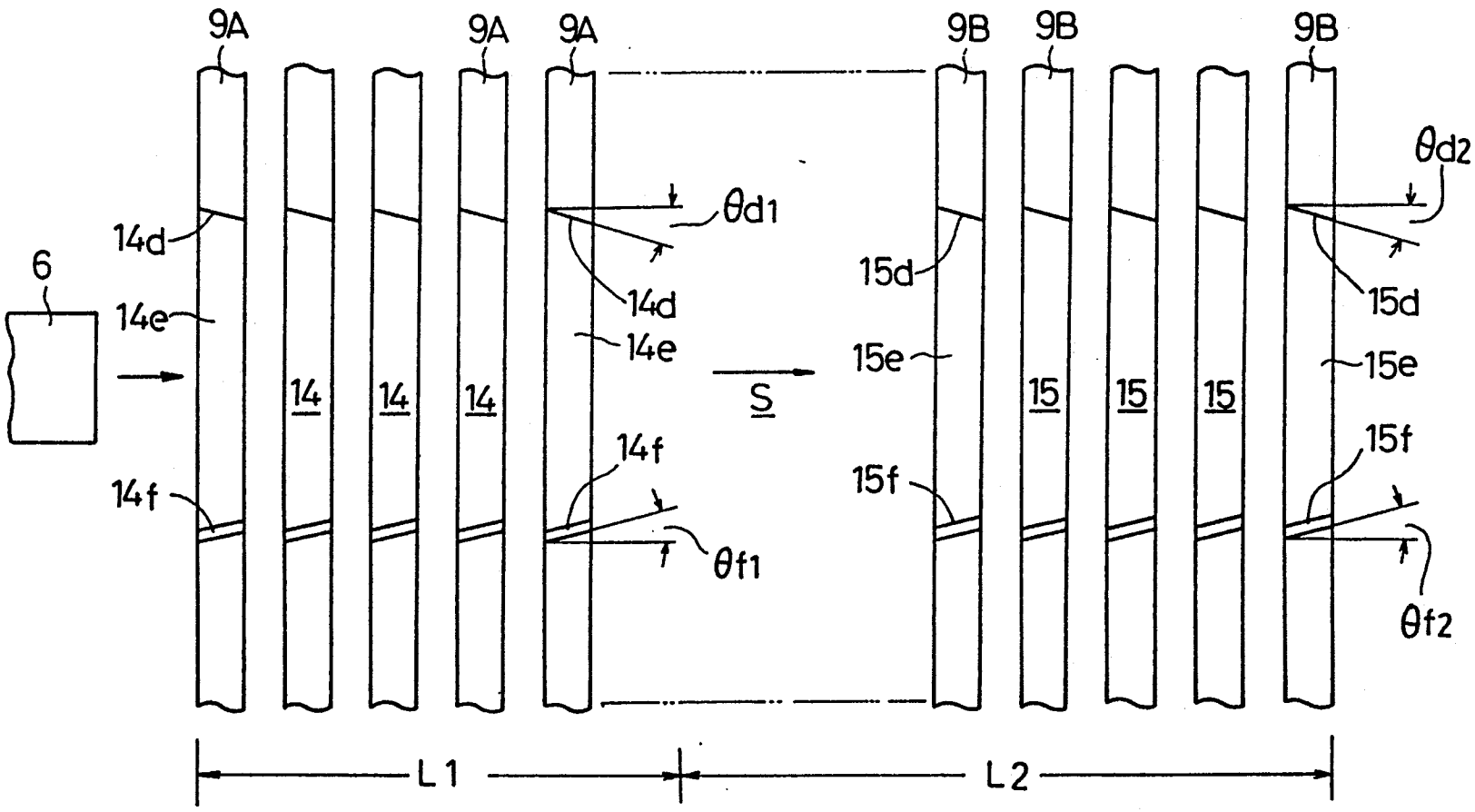
FIG. 7 is a diagrammatic view illustrating a reed in production, for a weft insertion device according to a third embodiment of the present invention.

The reed is formed by weaving the individual reed pieces (9A, 9B), spaced away at given intervals, as shown in FIG. 7, using the upper and lower stays shown in FIG. 1. Then, the individual wall surfaces of the guide openings 14 and 15 forming the weft passage (S) are polished in two steps, using a rotary polishing machine 24.

Figure 12:
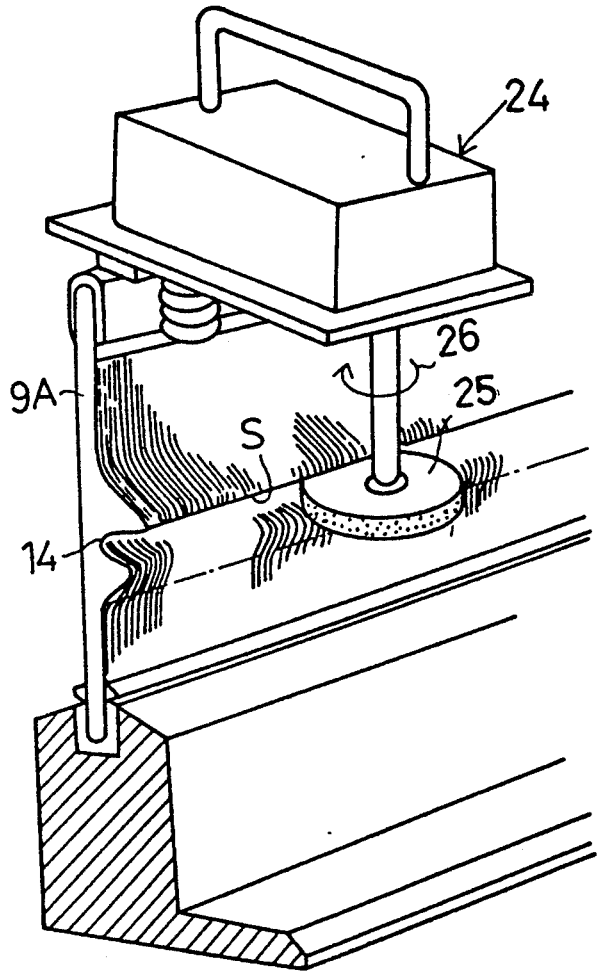
FIG. 12 is a perspective view illustrating how the wall portions of the guide openings of reed pieces are polished by a polishing machine.
Figure 13:
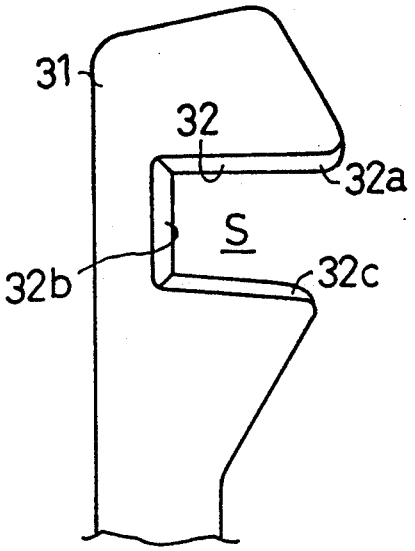
Fig. 13 (Prior Art)
FIG. 13 is a diagram showing the essential portion of a conventional open type reed piece.

The rotary polishing machine 24 used is the same type as a well-known polishing machine for a metal reed, which is disclosed in Japanese Examined Patent Publication No. 61-32416. As shown in FIG. 12, the polishing machine 24 has a disk-shaped polishing buff 25 that is rotatable in the forward and reverse directions. The polishing machine 24 is attached movably across the reed to the top of the reed, in such a way that part of the polishing buff 25 can contact and slide on the wall portions of the guide openings, at the time of polishing the wall portions of the guide openings of the reed pieces 9A (9B).

In the first polishing step, the polishing buff 25 is rotated in the forward direction (in the direction of the arrow 26) so as to polish the wall portions of the guide openings, from the beginning of the weft passage (S) toward the end thereof. While the polishing buff 25 is being rotated in the forward direction, the polishing machine 24 is moved forward from the weft insertion inlet end of the weft passage (S) to the outlet end thereof, for polishing only the top wall surfaces (14*d*, 15*d*) of all the guide openings (14, 15).

This forward rotational polishing made the inclination angles $\Theta_{d1}$ and $\Theta_{d2}$ of the top wall surfaces 14*d* and 15*d* larger than the inclination angles which were made naturally by the stamping. The inclination angles of the top wall surfaces (14*d*, 15*d*), the side wall surfaces (14*e*, 15*e*) and the bottom wall surfaces (14*f*, 15*f*) of all the guide openings (14, 15) shown in FIG. 7 were made to satisfy the relationship given by equation (6). In the second polishing step, the polishing buff 25 is rotated in the reverse direction (in the opposite direction of the arrow 26) so as to polish the wall portions of the guide openings from the end of the weft passage (S) toward the beginning thereof. While the polishing buff 25 is being rotated in the reverse direction, the polishing machine 24 is moved backward from the end of the weft passage (S) to the beginning thereof, for polishing the side wall surfaces and bottom wall surfaces of the guide openings 14 of the individual reed pieces 9A located in the front section L1.

This reverse rotational polishing formed-the second side wall surface 14*g* and the second bottom wall surface 14*h*, reversely inclined relative to the respective first side wall surface 14*e* and the first bottom wall surface 14*f*, on the side wall and bottom wall of each reed piece 9A, as shown in FIGS. 8 and 9.

Figure 11:
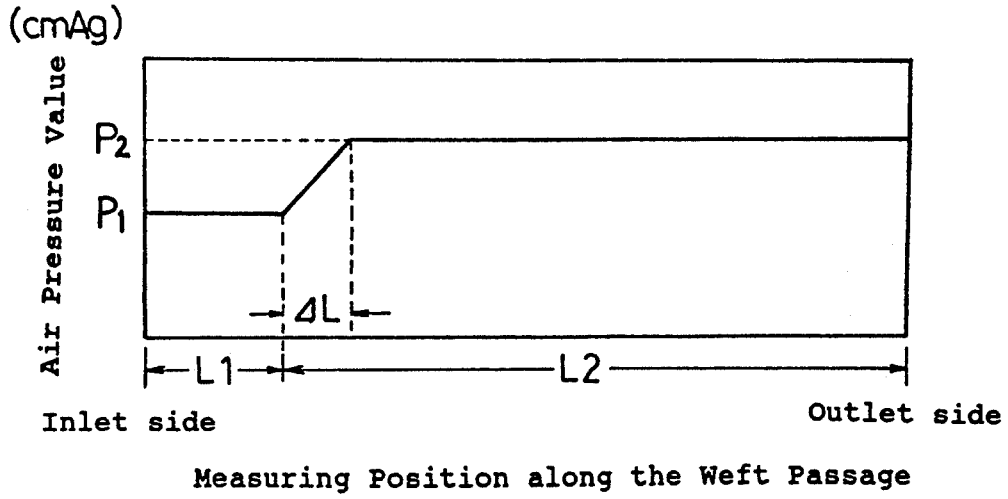
FIG. 11 is a graph showing the measured values of air pressure at individual positions on the opening side of the weft passage.

The reed is produced with the forward and reverse rotational polishings, such that the measured values of the pressure of air leaking toward the opening side of the weft passage (S) is distributed as shown in FIG. 11, when the reed is mounted on a jet loom. FIG. 11 shows that the air pressure value in most part of the rear section L2 is set to $P_2$ with respect to the air pressure value $P_1$ in the front section L1 ($P_1 < P_2$). A transient section $\Delta L$ where the air pressure value rises to $P_2$ from $P_1$, is about one half the front section L1.

In general, the guide opening of a reed piece prepared by stamping with a press machine has wall surfaces that originally have an inherent inclination angle. It is not necessarily easy to give the wall surfaces, already inclined in one direction, inclination angles subtly differing between the front section L1 and rear section L2, as performed in the first and second embodiments.

According to this method, with the inclination angles of the forward inclined wall surfaces in the front section L1 matching the inclination angles of the corresponding forward inclined wall surfaces in the rear section L2, the second wall surfaces inclined reversely to the wall portions in the front section L1 are formed by polishing.

Therefore, unlike the first and second embodiments, it is unnecessary to set significantly different inclination between the front section L1 and the rear section L2. This method can thus easily form the wall surfaces (14*d*–14*h* and 15*d*–15*f*) having the proper inclination angles on the individual guide openings 14 and 15 of the reed.

In the aforementioned forward rotational polishing step, the forward inclined side wall surfaces and bottom wall surfaces of the individual guide openings 14 and 15 may also be polished. Further, the reverse rotational polishing may be performed before the forward rotational polishing.

As described above in detail, a weft insertion device and a reed therefor, according to the present invention, can prevent the flying trouble, while maintaining the high weft flying speed throughout the weft passage. Accordingly, they are extremely useful as a constituent device and a constituent member for a jet loom.

What is claimed is:

1. A weft insertion device in a jet loom comprising:

a reed provided with a plurality of reed pieces, wherein each reed piece has a recessed guide opening, and wherein a plurality of said guide openings form a weft passage having a longitudinal axis where a weft flies;

a main nozzle for directing a weft toward said weft passage;

one or more sub-nozzles for directing a gas toward said weft passage to help the weft fly;

wherein said reed pieces are divided into a first and a second group with said first group located closer to and said second group located farther from said main nozzle;

wherein each of said guide openings has at least one inclined wall surface for guiding said gas flowing through said weft passage;

wherein said wall surfaces of said reed pieces that are located in said second group are equally inclined;

wherein said wall surfaces of said reed pieces that are located in said first group have a smaller inclination angle than that of said wall surfaces of said reed pieces located in said second group;

wherein said wall surface of each reed piece includes a top wall surface, a side wall surface and a bottom wall surface forming said guide opening;

wherein said top wall surface and said bottom wall surface are both inclined; and wherein the inclination angle of said bottom wall surface in each guide opening is smaller than the inclination angle of said top wall surface in said guide opening.

2. The weft insertion device according to claim 1 wherein the length in the weft insertion direction of said first group is within the range of 50 mm to 500 mm.

3. A weft insertion device in a jet loom comprising;

a reed provided with a plurality of reed pieces, wherein each reed piece has a recessed guide opening, and wherein a plurality of said guide openings form a weft passage having a longitudinal axis where a weft flies;

a main nozzle for directing a weft toward said weft passage;

one or more sub-nozzles for directing a gas toward said weft passage to help the weft fly;

wherein said reed pieces are divided into a first and a second group with said first group located closer to and said second group located farther from said main nozzle;

wherein each of said guide openings has at least one inclined wall surface for guiding said gas flowing through said weft passage;

wherein said wall surfaces of said reed pieces that are located in said second group are equally inclined;

wherein said wall surfaces of said reed pieces that are located in said first group have a smaller inclination angle than that of said wall surfaces of said reed pieces located in said second group;

wherein each of said reed pieces has wall portions defining said respective guide openings, said wall portions including first wall surfaces inclined, in the direction of weft insertion, toward the longitudinal axis of the weft passage; and wherein said wall portions of said reed pieces that are located in said first group further include second wall surfaces that re inclined relative to the weft passage in a direction opposite that of said first wall surfaces.

4. The weft insertion device according to claim 3, wherein the length of said first section is within the range of 50 mm to 500 mm.

5. A reed for use in a weft insertion device for a jet loom, comprising:

a plurality of reed pieces each having a recessed guide opening with said guide openings cooperating to form a weft passage through which a weft can fly from a weft insertion inlet end of said passage at one end of said reed to an outlet end of said weft passage at the opposite end of said reed, said reed pieces being divided into a first and second group of reed pieces with the first group located adjacent said one end of said reed and having a predetermined length;

said guide openings being defined by boundary walls of said reed pieces;

first surfaces formed on said boundary walls which surfaces are inclined relative to the longitudinal axis of said weft passage so as to converge toward said passage axis in the direction of weft travel; and second surfaces formed on said boundary walls of said guide openings in said first group of reed pieces, said second surfaces diverging from said passage axis in the direction of weft travel, said second surfaces intersecting said first surfaces of said first group of reed pieces.

6. The reed according to claim 5, wherein said predetermined length of said first group of reed pieces is within the range of 50 mm to 500 mm.

7. A method of producing a reed as recited in claim 5, the method comprising the following steps:

a) assembling a plurality of said reed pieces, said reed pieces being spaced apart at given intervals, and aligning said guide openings of said reed pieces to form said weft passage;

b) polishing the individual guide openings in the direction from the weft-insertion inlet end of said weft passage toward an outlet end of said weft passage, forming said inclined first surfaces dropping toward the weft passage along said weft insertion direction; and c) polishing the individual guide openings of the reed pieces located in said first group of reed pieces in the direction from said weft-insertion outlet end of said weft passage towards said weft-insertion inlet end to form said second surfaces.

8. The method according to claim 7, using a rotatable disk-shaped polishing buff for polishing said individual guide openings in both a forward and a reverse direction as a polishing member, wherein said polishing in said forward and said reverse directions is carried out by clockwise and counter-clockwise rotations of said polishing buff.

* * * * *

UNITED STATES PATENT AND TRADEMARK OFFICE

CERTIFICATE OF CORRECTION

PATENT NO. : 5,323,814
DATED : June 28, 1994
INVENTOR(S) : M. Shiraki et al

It is certified that error appears in the above-indentified patent and that said Letters Patent is hereby corrected as shown below:

Column 7, line 9, before "$\theta_{cl}$," insert a parenthesis --(--;
line 67, before "and" delete the comma ",".

Column 9, line 46, after "formed" delete the hyphen "-".

Column 10, line 60, after "1" insert comma --,--.

Column 11, line 27, "re" should read --are--.

Signed and Sealed this

Sixth Day of December, 1994

*Attest:*

*Attesting Officer*

BRUCE LEHMAN

*Commissioner of Patents and Trademarks*